United States Patent [19]

Hirose et al.

[11] 4,451,813

[45] May 29, 1984

[54] VACUUM FUSE HAVING MAGNETIC FLUX GENERATING MEANS FOR MOVING ARC

[75] Inventors: Kengo Hirose; Norio Kudo, both of Tokyo, Japan

[73] Assignee: Japan Radio Company, Ltd., Tokyo, Japan

[21] Appl. No.: 468,677

[22] Filed: Feb. 22, 1983

Related U.S. Application Data

[63] Continuation of Ser. No. 272,208, Jun. 10, 1981, abandoned, which is a continuation of Ser. No. 70,412, Aug. 28, 1979, abandoned.

[51] Int. Cl.[3] ..... H01H 85/38

[52] U.S. Cl. ..... 337/17; 200/144 B

[58] Field of Search ..... 337/17, 28, 31, 33, 337/34, 142, 273, 278; 200/144 B

[56] References Cited

U.S. PATENT DOCUMENTS

| | | | |
|---|---|---|---|
| 2,949,520 | 8/1960 | Schneider | 200/144 |
| 3,283,103 | 11/1966 | Greenwood et al. | 200/147 |
| 3,587,024 | 6/1971 | Cutris | 337/273 |
| 3,683,139 | 8/1972 | Ludwig | 200/144 B |
| 3,818,164 | 6/1974 | Mizutani et al. | 200/144 B |
| 3,913,047 | 10/1975 | Arthur | 337/17 |
| 4,109,123 | 8/1978 | Lipperts | 200/144 B |

*Primary Examiner*—William H. Beha, Jr.

*Attorney, Agent, or Firm*—Frishauf, Holtz, Goodman & Woodward

[57] ABSTRACT

A vacuum fuse includes a pair of metallic spiral elements of different wrapping directions mounted on inner end portions of axially aligned conductor rods. The radial inner ends of spiral elements are electrically connected to respective conductor rods and the radial outer ends are electrically connected to outer metallic rings, respectively. Arcing electrode disks are mounted to opposite axial ends of the outer rings to define confronting spaced apart and parallel arcing surfaces. A fusible element is connected between the conductor rods. When the fusible element is broken by an excess current, an arc is produced between the arcing surfaces and a magnetic flux is induced by the current flowing through the spiral elements. The magnetic flux causes the arc to move so that each arcing electrode is prevented from being locally heated, thereby improving the current interrupting property of the fuse.

18 Claims, 4 Drawing Figures

VACUUM FUSE HAVING MAGNETIC FLUX GENERATING MEANS FOR MOVING ARC

This is a continuation of application Ser. No. 272,208 filed June 10, 1981, which is a Continuation of parent U.S. Ser. No. 070,412, filed Aug. 28, 1979, now abandoned.

BACKGROUND OF THE INVENTION

This invention relates to vacuum fuses.

Generally speaking, a vacuum fuse comprises fuse elements contained in an evacuated sealed housing, and has advantages that neither gas nor vapoured metals are discharged in the environment, that since the arc caused at the current interruption is confined in a vacuum housing, arcing energy is less so that the fuse is excellent in safety considerations because the withstand voltage of the fuse is high after interruption.

A known vacuum fuse in the prior art includes an evacuated dielectric housing 1 within which the fuse elements are housed, as shown in FIG. 1. The fuse elements include a pair of conductor rods 2*a* and 2*b* which are arranged end-to-end on an axis. Arcing electrodes 3*a* and 3*b* are connected and supported on the inner ends of the conductor rods. The arcing electrodes are generally disk-shaped and are arranged parallel to each other to define confronting arcing surfaces between which gap 4 is defined. A fusible element 5 is electrically connected to the conductor rods through the arcing electrodes to bridge the gap between the arcing surfaces.

When an excess current due to, for example, an overload occurs, the fusible element 5 melts and is almost instantly broken and consumed to interrupt the current flowing therethrough. However, current continues to flow through the device by the arc caused between the arcing surfaces. The arc extinguishes when the current falls substantially to a zero value so that the current interruption is completed.

A known vacuum fuse of this type is dislcosed in U.S. Pat. No. 3,913,047.

In the known, vacuum fuse, the arc is affected by not only the self-induced magnetic field of the arcing current but also the external magnetic field induced by the current flowing in an external circuit near the fuse, and, the movement of the arc on the arcing surfaces is, therefore, unreliably effected. The arc tends to concentrate at the peripheral end of each arcing surface, so that the arcing electrodes are locally heated and melted to discharge an excess amount of vapoured metal. This degrades the interrupting property of the vacuum fuse.

SUMMARY OF THE INVENTION

It is an object of this invention to provide a vacuum fuse having an improved current interrupting property.

It is another object of this invention to provide an improved vacuum fuse wherein the arcing surfaces are prevented from being locally heated by the arc formed at a time when the fusible element is broken.

It is still another object of this invention to provide a vacuum fuse wherein the movement of the arc on the arcing surfaces is reliably effected to prevent the local heating of the arcing surface so that the interrupting property is improved.

It is yet another object of this invention to provide a vacuum fuse wherein the arc is effectively formed over the arcing surfaces and is effectively confined within the gap between the confronting surfaces.

It is a further object of this invention to provide a vacuum fuse wherein the arcing energy is reduced.

It is a still further object of this invention to provide a vacuum fuse of simple construction and compact size realizing the above described objects.

A vacuum fuse according to this invention is characterized in that a coil means is provided within the housing to axially or radially flow magnetic flux in the gap between arcing surfaces from a time when the fusible element is broken and until the arc extinguishes. The arc is reliably moved by the magnetic field and, therefore does not locally heat the arcing surfaces.

According to an aspect of this invention, a vacuum fuse comprises an evacuated dielectric housing. A pair of conductor rods are supported by and through the housing and are arranged end-to-end on an axis within the housing. On the inner end portions of the conductor rods, a pair of coil means or conductive spiral element means are mounted with their radial inner ends being electrically connected to the conductor rods. Winding directions of the spiral elements are different as viewed in an axial direction under the condition as mounted on respective conductor rods. A pair of arcing electrode means are disposed adjacent respective inner ends of the conductor rods and are electrically connected to respective radial outer ends of the spiral element means. The arcing electrode means are supported by respective spiral element means to define confronting arcing surfaces generally in parallel with one another and with a space therebetween. The arcing electrode means have small holes opposite the inner ends of the conductor rods. A fusible element means is connected to the inner ends of the conductor rods and extends in the space between the arcing surfaces through the small holes without contacting the arcing electrode means.

When the fusible element means is broken by an excess current, current continues to flow through the spiral element means and the arcing electrode means due to the existence of the arc in the space between the arcing electrode means. Magnetic flux is generated by the current flowing through the spiral element means and flows in a direction from one arcing electrode to the other. The magnetic flux causes the arc in the space to incline and lengthen the arc. The arc moves towards the periphery of the arcing surfaces by the self-induced magnetic flux. Therefore, the inclined and lengthened arc extinguishes near the periphery and at the time, a new arc is caused at the central portion of the arcing surface. This phenomenon is repeated, so that the arc is apparently and effectively dispersed over the arcing surfaces and is confined within the space between the confronting arcing surfaces. Therefore, since the arcing energy is reduced and since the arcing surfaces are prevented from the local heating, the interrupting property is enhanced.

According to another aspect of the invention, the two spiral elements are mounted on respective inner end portions of the conductor rods in such an orientation that the winding directions of spiral elements are same as viewed from an axial direction. In this arrangement, the magnetic flux induced by the current flowing though the spiral elements radially flows in the space between the confronting arcing surfaces. Therefore, the arc is moved along a circular trace. The arc also tends to outwardly move by the self-induced magnetic flux. Accordingly, the arc is moved along a spiral trace.

Therefore, the arcing surfaces are not locally heated so that the interrupting property is enhanced.

Either one of the spiral element means may be omitted. At the omitted side, the arcing electrode means is directly supported on the inner end of the conductor rod.

Further objects and features and other aspects of this invention will be understood from the following detailed description of preferred embodiments of this invention referring to the annexed drawings.

DETAILED DESCRIPTION OF PREFERRED EMBODIMENTS

Figure 1:
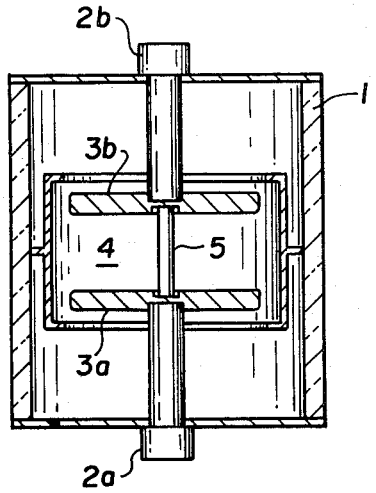
Fig.1 PRIOR ART
FIG. 1 is a sectional view of a known vacuum fuse.
Figure 2:
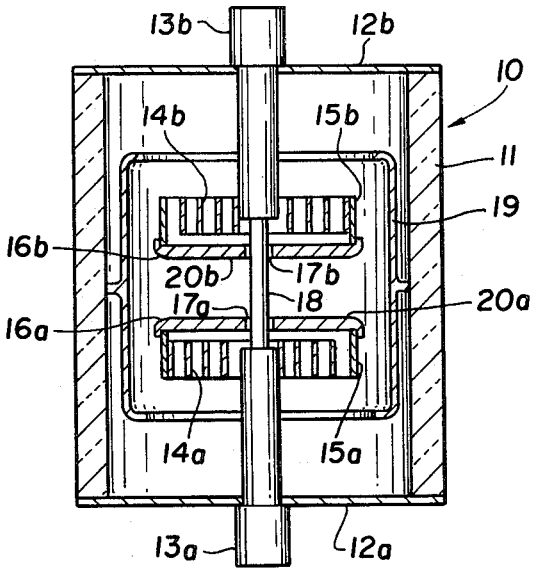
FIG. 2 is a sectional view of an imbodiment according to this invention.
Figure 3:
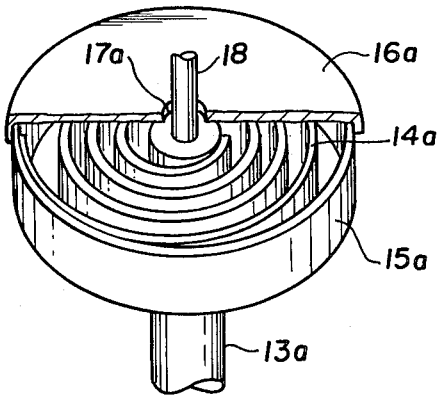
FIG. 3 is an enlarged and partially cut away perspective view of a main part in the embodiment of FIG. 2.

Referring to FIGS. 2 and 3, the vacuum fuse 10 of an embodiment of this invention includes a cylindrical casing 11 of glass, glass ceramic, or other ceramics. End walls 12*a* and 12*b* of the housing are mounted onto the opposite ends of the casing 11 with outer edges thereof being hermetically sealed to the ends of the casing. A pair of conductor rods 13*a* and 13*b* are supported by end walls 12*a* and 12*b* and so arranged end-to-end on an axis with a space therebetween within the casing 11. The conductor rods 13*a* and 13*b* are hermetically sealed to the end walls 12*a* and 12*b*. A pair of spiral metallic elements 14*a* and 14*b* of, for example, copper, are mounted on respective inner end portions of the conductor rods 13*a* and 13*b*. The spiral elements are supported on, and are electrically connected to, the conductor rods 13*a* and 13*b* by the radial inner ends of the spiral elements being secured to respective conductor rods. The spiral elements 14*a* and 14*b* are contained in metallic outer rings 15*a* and 15*b* of, for example, copper, respectively, and are electrically connected to the respective outer rings at the radial outer ends. A pair of disk-shaped arcing electrodes 16*a* and 16*b* of, for example, copper, are respectively mounted onto confronting axial ends of the outer rings 15*a* and 15*b* to define confronting spaced and parallel arcing surfaces 20*a* and 20*b*, and are electrically connected to respective outer rings. The arcing electrodes 16*a* and 16*b* are formed with small central holes 17*a* and 17*b*. A fusible conductive element 18 is connected to conductor rods 13*a* and 13*b* and extends through the holes 17*a* and 17*b* to be electrically connected between the conductor rods. A shield ring 19 is disposed within, and supported by, the casing 11 to surround the fusible element and arcing electrodes.

The housing 11 is evacuated by a conventional method to produce a vacuum.

Each outer ring of 15*a* and 15*b* is axially longer than each spiral element 14*a* and 14*b* to axially project in relation to the spiral element. On the axially projecting end, each arcing electrode of 16*a* and 16*b* is mounted. Therefore, each arcing electrode is electrically connected with the corresponding spiral element only through the outer ring.

In accordance with an aspect of this invention, the winding directions of spiral elements 14*a* and 14*b* are the same, as viewed from respective accompanying arcing electrodes. Therefore, under the assembled condition as shown in FIG. 2, the winding directions of spiral elements 14*a* and 14*b* are different as viewed in an axial direction.

When the fusible element 18 is broken by an excess current, an arc is caused. Since the arcing electrodes 16*a* and 16*b* are electrically connected to respective conductor rods 13*a* and 13*b* through respective spiral elements 14*a* and 14*b* and respective outer rings 15*a* and 15*b*, the arc transfers immediately to arcing surfaces 20*a* and 20*b*. At a time, magnetic flux is induced in an axial direction by the current flowing through spiral elements 14*a* and 14*b* to flow in the space between arcing surfaces 20*a* and 20*b* from one arcing surface to the other. The arc is moved toward the periphery of the arcing surfaces due to the self-induced magnetic flux. The magnetic flux induced by the current flowing through the spiral elements influences the arc to be inclined and lengthened. Therefore, the arc extinguishes near the periphery of the arcing surfaces while a new arc is formed at or near the central portion of the arcing surfaces. The new arc is also inclined and lengthened, and extinguishes near the periphery of the arcing surfaces. Thus, the formation, movement, and extinction of the arc are repeated. Therefore, the arc is effectively dispersed over arcing surfaces and is apparently and effectively confined within the space between the arcing electrodes statically. Accordingly, the arc energy is reduced and the local heating up of the arcing surfaces is prevented, so that the interrupting property is enhanced.

According to another aspect of this invention, the winding directions of spiral elements 14*a* and 14*b* are different as viewed from respective accompanying arcing electrodes. Therefore, under the assembled condition, the winding directions of spiral elements 14*a* and 14*b* are the same, as viewed in an axial direction.

In such an arrangement, the magnetic flux induced by the current flowing through the spiral elements 14*a* and 14*b* radially flows in the space between the arcing electrodes 16*a* and 16*b*. The arc is moved along a circular path by the radial magnetic flux. But the arc also moves outwardly by the self-induced magnetic flux. Accordingly, the arc moves along a spiral path. Therefore, the arc is prevented from concentrating at a point on each arcing surface so that the arcing electrodes 16*a* and 16*b* are not locally heated. Thus, the current interrupting property of the fuse is improved.

The arcing electrodes also have a heat sink effect for themselves.

In the illustrated embodiment, since the arcing electrodes 16*a* and 16*b* are not in contact with the fusible element 18, the heat sink effect is not for the fusible element 18, so that the melting time of the fusible element is shortened.

Figure 4:
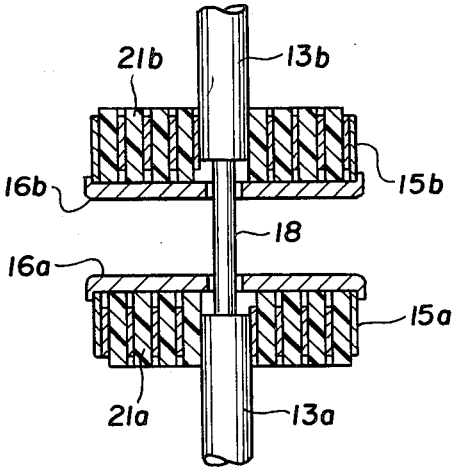
FIG. 4 is a sectional view of a fuse element according to another embodiment of this invention.

Referring to FIG. 4, another embodiment shown is characterized in that dielectric materials 21*a* and 21*b*, for example, such as glass, glass ceramic, or other ceramics are filled up as spacers in the spaces of outer rings 16*a* and 16*b* as well as in the pitches of spiral elements 14*a* and 14*b*. Thus, each spiral element is non-vibratingly supported and is prevented from short-circuiting itself between turns of the spiral and also between it and the outer ring.

In place of the dielectric materials, electrically insulating means of higher resistance than the outer ring and spiral element, for example, stainless steel is fixedly disposed in spaces in the outer ring and between turns of spiral element.

One of the spiral elements may be omitted. In this case, the arcing electrode at the omitted side is directly supported on, and electrically connected to, the corresponding conductor rod.

In the above described embodiment, a single spiral element is mounted at each conductor rod. But, a plurality of spiral elements may be interfitted and mounted on a conductive rod. In this case, radial inner ends of interfitting spiral elements are electrically connected to the conductive rod, and the radial outer ends are connected to the outer ring.

In this invention, the magnetic flux generating means, or spiral elements operates at a time when the fusible element is broken and does not operate before the break of the fusible element. Therefore, there is an advantage that energy is not needlessly wasted.

This invention has been described in detail with reference to preferred embodiments, but these are examples only and the invention is not restricted to those embodiments. It will be readily understood by those skilled in the art that various modifications and alterations maybe made within the scope of the invention as defined by the appended claims.

What is claimed is:

1. In a vacuum fuse comprising a sealed evacuated dielectric housing, first and second electrically conductive members fixedly supported by and through the dielectric housing and arranged so that inner ends of said first and second conductive members confront one another to form a predetermined fixed space therebetween, first and second arcing electrode means disposed at respective inner ends of said first and second conductive members to define a fixed gap between entirely continuous, non-interrupted annular confronting surfaces thereof, said first and second arcing electrode means being electrically connected with respective first and second conductive members, and an electrically conductive fusible element means connected between said first and second conductive members and bridging said fixed gap between said first and second arcing electrode means, the improvement which comprises in combination:

said confronting surfaces of said first and second arcing electrode means each being substantially flat;

at least one coil means having an inner connecting end and an outer connecting end, said coil means being mounted on the inner end of at least said first electrically conductive member, said inner connecting end of said coil means being electrically connected to said first electrically conductive member and said outer connecting end thereof being electrically connected to a peripheral edge of the confronting surface of said first arcing electrode means, said at least one coil means forming said electrical connection between said first arcing electrode means and said first electrically conductive member and supporting said first arcing electrode means, said coil means being formed so that magnetic flux is produced in said fixed gap by arc current flowing through said at least one coil means when an arc is produced between the confronting surfaces of said first and second arcing electrode means at a time when said fusible element means melts, said magnetic flux being sufficient to cause said arc to move toward and extinguish at said peripheral edge as said arc is confined solely within said fixed gap between said entirely continuous substantially flat annular confronting surfaces, and said first arcing electrode means having a substantially central hole in the entirely continuous annular confronting surface thereof through which hole said fusible element means extends without contacting said first arcing electrode means to connect directly with said first conductive member, so that current flow through said at least one coil means is prevented before said fusible element means melts, and said arc current is directed to the peripheral edge of the confronting surface of said first arcing electrode means through said at least one coil means at a time when said fusible element means melts to produce an arc between said entirely continuous substantially flat annular confronting surfaces.

2. The vacuum fuse as claimed in claim 1, wherein said hole in said first arcing electrode means is located substantially centrally of the confronting surface of said first arcing electrode means.

3. The vacuum fuse as claimed in claim 1, wherein said first and second arcing electrode means each comprises a substantially disk-shaped member.

4. The vacuum fuse as claimed in claim 1, wherein said at least one coil means comprises at least one spiral metallic element having said inner connecting end secured and electrically connected to an outer surface of an inner end portion of said first electrically conductive member, and said outer connecting end electrically connected to said first arcing electrode means.

5. The vaccum fuse as claimed in claim 4, wherein said hole in said first arcing electrode means is located substantially centrally of the confronting surface of said first arcing electrode means.

6. The vacuum fuse as claimed in claim 4, wherein said at least one coil means further comprises an outer metallic ring concentrically surrounding said spiral metallic element and electrically connected with the outer connecting end of said spiral metallic element, said outer ring supporting and being electrically connected with the peripheral edge of the confronting surface of said first arcing electrode means to thereby connect the outer end of said spiral metallic element to the peripheral edge of said first arcing electrode means through said outer metallic ring.

7. The vacuum fuse as claimed in claim 6, wherein said hole in said first arcing electrode means is located substantially centrally of the confronting surface of said first arcing electrode means.

8. The vacuum fuse as claimed in claim 6, wherein said at least one coil means further comprises spacer means fixedly disposed in an inner space of said outer ring and in pitches of said spiral metallic element to prevent short-circuiting of adjacent turns in said spiral metallic element and between said spiral metallic element and said outer ring.

9. The vacuum fuse as claimed in claim 8, wherein said hole in said first arcing electrode means is located substantially centrally of the confronting surface of said first arcing electrode means.

10. The vacuum fuse as claimed in claim 8, wherein said spacer means is ceramic material.

11. The vacuum fuse as claimed in claim 8, wherein said spiral metallic element and said outer ring are copper, and said spacer means is stainless steel.

12. The vacuum fuse which comprises:

a sealed evacuated dielectric housing;

first and second electric conductor rods each fixedly supported by and through opposite ends of said dielectric housing, said conductor rods being arranged so that inner ends thereof confront one another coaxially with a predetermined fixed space therebetween;

electrically conductive fusible element means connected between the confronting inner ends of said first and second conductor rods to extend through said predetermined fixed space;

first and second electrically conductive spiral coil means each having a radially inner connecting end and a radially outer connecting end, each of said coil means being mounted on a respective inner end of said first and second conductor rods, the radially inner connecting ends of each of said spiral coil means being mechanically and electrically connected with respective ones of said conductor rods;

first and second electrically conductive outer ring members for concentrically containing respective ones of said first and second spiral coil means, and mechanically and electrically connected with respective radially outer ends of said first and second coil means to be supported thereon; and first and second arcing electrode disk members mounted on, and electrically connected with, respective axially opposite ends of said first and second outer ring members, said electrode disk members having entirely continuous substantially flat annular surfaces which confront one another with a fixed gap therebetween, each disk member having a central hole in its confronting surface through which hole said fusible element means extends without contacting said disk members, so that current flow through said first and second spiral coil means and said first and second arcing electrode disk members is prevented before said fusible element means melts, and arc current is directed to the peripheral edges of the confronting surfaces of said electrode disk members through said first and second spiral coil means at a time when said fusible element means melts to produce an arc between said substantially flat confronting surfaces;

wherein said first and second conductive spiral coil means are constructed and arranged to produce magnetic flux in said fixed gap from said arc current so that said arc moves toward and extinguishes at said peripheral edges as said arc is confined solely within said fixed gap between said entirely continuous substantially flat annular confronting surfaces of said electrode disk members.

13. The vacuum fuse as claimed in claim 12, which further comprises a generally cylindrically shaped shield connected to the interior of said housing around said fixed gap between said first and second arcing electrode disk members.

14. The vacuum fuse as claimed in claim 12, which further comprises spacer means fixedly disposed in the inner space of each outer ring member and in pitches of each spiral coil means to prevent short-circuiting of adjacent turns in each spiral coil means and between each spiral coil means and the corresponding outer ring member.

15. The vacuum fuse as claimed in claim 14, wherein said spacer means is a ceramic material.

16. The vacuum fuse as claimed in claim 14, wherein each spiral coil means and each outer ring member are copper, and said spacer means is stainless steel.

17. The vacuum fuse as claimed in claim 12, wherein the winding directions of said first and second spiral coil means are different as viewed in an axial direction.

18. The vacuum fuse as claimed in claim 12, wherein the winding directions of said first and second spiral coil means are the same as viewed in an axial direction.

* * * * *